US010358319B2

(12) United States Patent
Salmikuukka et al.

(10) Patent No.: US 10,358,319 B2
(45) Date of Patent: Jul. 23, 2019

(54) ALLOCATION OF ELEVATORS IN ELEVATOR SYSTEMS BASED ON INTERNAL DATABASE

(71) Applicant: KONE Corporation, Helsinki (FI)

(72) Inventors: Jukka Salmikuukka, Espoo (FI); Samu Salmelin, Helsinki (FI)

(73) Assignee: KONE CORPORATION, Helsinki (FI)

( * ) Notice: Subject to any disclaimer, the term of this patent is extended or adjusted under 35 U.S.C. 154(b) by 566 days.

(21) Appl. No.: 15/148,291

(22) Filed: May 6, 2016

(65) Prior Publication Data

US 2016/0251198 A1 Sep. 1, 2016

Related U.S. Application Data

(63) Continuation of application No. PCT/EP2013/073808, filed on Nov. 14, 2013.

(51) Int. Cl.

*B66B 1/34* (2006.01)
*B66B 1/24* (2006.01)
*B66B 1/46* (2006.01)

(52) U.S. Cl.

CPC ..... *B66B 1/2458* (2013.01); *B66B 1/468* (2013.01); *B66B 2201/103* (2013.01); *B66B 2201/223* (2013.01); *B66B 2201/4615* (2013.01); *B66B 2201/4653* (2013.01)

(58) Field of Classification Search

CPC . B66B 1/2458; B66B 1/468; B66B 2201/103; B66B 2201/223; B66B 2201/4615; B66B 2201/4653

USPC ..... 187/247, 380–391, 392

See application file for complete search history.

(56) References Cited

U.S. PATENT DOCUMENTS

| | | | | |
|---|---|---|---|---|
| 5,949,037 | A | 9/1999 | Oya | |
| 6,202,799 | B1 | 3/2001 | Drop | |
| 8,584,811 | B2 * | 11/2013 | Kuoppala | B66B 1/468 187/316 |
| 8,646,581 | B2 * | 2/2014 | Iwata | B66B 1/468 187/387 |
| 9,087,213 | B2 * | 7/2015 | Skaaksrud | G06F 21/6245 |
| 9,284,158 | B2 * | 3/2016 | Sarjanen | B66B 1/468 |
| 9,650,225 | B2 * | 5/2017 | Salmikuukka | B66B 1/2458 |
| 9,908,743 | B2 * | 3/2018 | Herkel | B66B 1/302 |
| 10,035,679 | B2 * | 7/2018 | Armistead | B66B 1/46 |
| 2001/0035314 | A1 * | 11/2001 | Yoshida | B66B 1/463 187/382 |
| 2016/0122157 | A1 * | 5/2016 | Keser | B66B 1/468 187/388 |

FOREIGN PATENT DOCUMENTS

WO WO 2009/122002 A1 10/2009

* cited by examiner

*Primary Examiner* — Anthony J Salata
(74) *Attorney, Agent, or Firm* — Birch, Stewart, Kolasch & Birch, LLP

(57) ABSTRACT

A method for allocation of elevators in an elevator system, including identifying at least one passenger, searching for a group or groups the at least one passenger is assigned to in an internal database, or assigning the at least one passenger to a group or to groups, where the assignment is based on information of an internal database, and calling an elevator car for the at least one passenger and assigning to the elevator car the destination of one group the at least one passenger is assigned to.

20 Claims, 1 Drawing Sheet

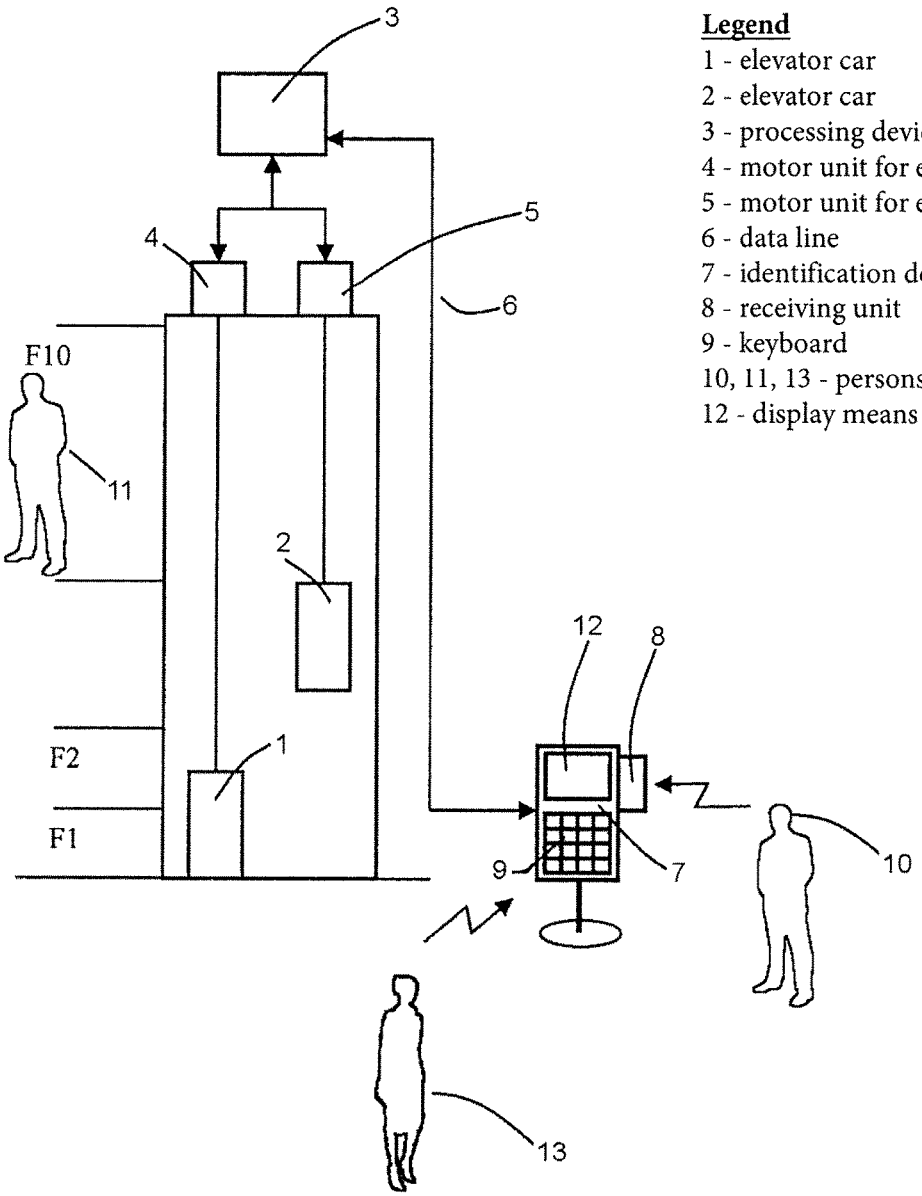
Legend
1 - elevator car
2 - elevator car
3 - processing device
4 - motor unit for elevator 1
5 - motor unit for elevator 2
6 - data line
7 - identification device
8 - receiving unit
9 - keyboard
10, 11, 13 - persons
12 - display means

ALLOCATION OF ELEVATORS IN ELEVATOR SYSTEMS BASED ON INTERNAL DATABASE

CROSS REFERENCE TO RELATED APPLICATIONS

This application is a Continuation of PCT International Application No. PCT/EP2013/073808, filed on Nov. 14, 2013, which is hereby expressly incorporated by reference into the present application.

FIELD OF THE INVENTION

The invention relates to a method for an allocation of elevators in elevator systems. More particularly the invention relates to the call allocation and related information sharing with special floor settings. The invention further relates to an elevator system realizing said method, as also to a program which when executing on a computer performs the method.

BACKGROUND OF THE INVENTION

Known in the art is a call-giving method regarding elevator systems wherein a passenger indicates his/her destination floor already before going into the elevator car by giving a so-called destination call in the elevator lobby. A destination call is generally given either by the aid of a destination call panel in the elevator lobby or by the aid of a personal call-giving device.

A personal call-giving device is e.g. an electronically readable ID card or a terminal device suited to giving a call. A terminal device is e.g. a mobile phone or a means of communication comparable to it, by the aid of which a passenger can send a destination call to the elevator system by radio frequency. An ID card is e.g. an identifier based on the RFID technology, the data stored in which identifier can be read e.g. with a reader device in the elevator lobby and can be registered as a destination call on the basis of the data read.

In modern office buildings there often happen to be no fixed seats for individuals but different kind of work places that are dynamically allocated to the employees. This means that when arriving in the morning, persons need to find a suitable work place in the office building or are informed about their actual working place.

The problem is that when the nature of the work is focusing more and more to team work and persons arrive to the building randomly, it is difficult to get the entire team effectively into the allocated working area for this team.

AIM OF THE INVENTION

The aim of the present invention is to disclose a solution, which eliminates or at least alleviates the drawbacks occurring in prior-art solutions presented above. The aim of the invention is also to achieve one or more of the following advantages:

- to enable a person to find his/her team in the modern office environment easily and fast,
- to facilitate the formation (configuration) of passenger groups, and to facilitate and speed up the transportation of passengers from the lobby.

It is also an object of the invention to improve the efficiency of work space and resource usage in dynamically changing environment.

SUMMARY OF THE INVENTION

The invention relates to a method for call allocation for elevators in elevator systems taking into account related information sharing with a dynamic home-floor setting of an elevator system based on the group of persons to which a passenger is assigned and adjustable location change of these groups of persons.

The method according to the invention and preferred embodiments are characterized by the claims. Some further inventive embodiments are also presented in the descriptive section and in the drawings of the present application. It is to be noted, that the features of the various embodiments of the invention can be applied within the scope of the basic inventive concept in conjunction with other embodiments.

The present invention discloses a method for allocating elevators in an elevator system, comprising one or more elevators, at least one identification device, suitable to identify certain passengers, and at least one processing device, suitable to activate calls for one or more individual elevators of the elevator system, based on the information of the at least one identification device.

Suitable identification devices are able to identify a person entering the building or at least intending to use an elevator of the elevator system. Examples of identification devices are already disclosed above. Preferred identification devices are manual devices (e.g. computers that are programmed by desk officers), ID-reader (e.g. card reader, barcode reader or RFID-terminals), visual devices (e.g. cameras with face-identification capabilities), or biometric scanners.

Suitable processing devices are able to process the passenger data, allocate a destination to an elevator car of the elevator system used by the respective passenger, call this elevator car to the position of the respective passenger and direct the elevator car to the allocated destination of the passenger. Preferred processing devices are computers or at least an assembly of certain components of a computer, microcontrollers or virtual environments in a computer system.

The method according to the invention comprises the steps:

a) Identifying at least one passenger, especially before entering an elevator car, e.g. while entering the building, passing a turnstile, arriving at the elevator zone or passing an identification point;

b) searching for the group or the groups the at least one passenger is assigned to in an internal database or assigning the at least one passenger to a group or to groups, where the assignment is based on information of an internal database;

c) calling an elevator car for this at least one passenger and assigning to this elevator car the destination of one group the at least one passenger is assigned to.

The identification of a person is preferably accomplished by using the identification devices, especially after the person has entered the building or the elevator zone or passed another special position in the building.

To identify a person there are preferably used items carried by this person, such as ID-cards or RFID-devices, and/or biometric features of this person, such as finger-prints or the face of this person. Some methods to identify a person are well known by the state of the art.

The searching for the group or the groups the respective person is assigned to is preferably executed by searching the identified person in an internal database of the system or an external database to which the processing device of the system has access and to look up the information to which group this person is assigned to.

Another preferred assignment procedure is executed by searching the profile of the identified person in the database and assign this person to a group where the profile fits best.

The calling of an elevator car for this at least one passenger is easily done when the elevator system comprises one elevator, only. In the case, the system comprises more than one elevator, the processing device preferably chooses the one elevator that is the most suitable for the transportation of the mentioned person to the assigned destination of the work group.

The assigning of the destination to this elevator car is achieved easily by looking up the position of the work group in the database by the processing device.

The destination floor for each member of the work groups particularly depends on the work area of the respective group. Thus, the work area of each person directly or indirectly indicates the destination floor.

The work area of each work group may be assigned by the first member of the respective group entering the building. However, it is also preferred that the work area of each work group is assigned automatically based on environmental data, by decision of authorities or by schedule. The automatic assignment is preferably organized by regarding the size of the project team and the maximum number of seats available in the working area and/or the requirement of special equipment by the respective working group. This kind of data may be stored into ACS or other suitable system means from which the information is captured and used as a part of dynamical home floor selection and elevator/workspace allocation.

In a preferred embodiment, a person using the system has the possibility to affect the allocation though additional input means. These means are preferably mobile devices ("MOP"), elevator system UI ("DOP"), manual input devices or system override means. This is advantageous in the case if a group member has an urgent appointment on another floor, or where a person is belonging to two or more groups. In that case the person could select directly the group he/she would like to anticipate and the elevator allocation would be done for the work area of that certain group.

In a further preferred embodiment the system comprises means to present information, preferably display means or means for data transfer. The display means can be used to show information for each identified person, e.g. about the group this person is actually assigned to, the location of team members, the team members already present in the work area or the exact position of the work area (e.g. floor and room number).

The means for data transfer could be used to send data to a mobile devices of a person where the information can be displayed.

Due to these means of above, persons are able to locate teams or team members in the building before making selections, or to check which members of the team have already been arrived. One advantage of this embodiment is the fact that other persons, e.g. new team members or the supervisor/manager of several groups are able to easily find an individual group.

The elevator system comprises at least one elevator. In cases the elevator system comprises more than one elevator, the allocation of the single elevator cars of the system could be optimized by at least the following methods.

In the case that two or more members of a certain work group are waiting for an elevator, these members could be assigned to one single elevator car, as well as preferably all other passengers with the same or a similar destination. The special assignment of the elevator is especially displayed for the respective passengers.

In the case of groups comprising a large number of members, one of the elevators could be reserved for passengers travelling to one certain floor (the floor comprising the work area of this group), only. This would be advantageous especially for conferences, congresses or other important meetings.

One additional advantage of the method of the invention beside the improved efficiency of transportation, shorter time to destination and better user experience is the fact that the information of groups and work areas are gathered in one system. This information, therefore, could easily be read from this system and linked to the members of the several groups via data transfer methods (e.g. via internet to outlook calendar or e-mail accounts).

In the following, the invention will be described in detail by the aid of examples of its embodiments, wherein:

FIG. 1 presents an elevator system suitable for the method of the present invention.

FIG. 1 presents an elevator system suitable for the method of the present invention. The elevator system forms an elevator group, which comprises two elevator cars 1 and 2, the elevator cars 1 and 2 are able to move in the elevator hoistway between the floors F1, F2 . . . F10. The elevator system is operated by processing device 3 that moves elevator car 1 via motor unit 4 and elevator car 2 via motor unit 5. In addition, processing device 3 receives signals over a data line 6 from identification devices 7 that are mounted at least on the ground floor, but preferably also in any lobby of floors F1 to F10. Every destination device 7 comprises means to identify a person, such as a receiving unit 8 or a keyboard 9 for manual identification.

In the FIGURE, three persons are shown wherein persons 10 and 11 are members of the same work group and person 13 is the supervisor of this group and other groups.

When person 10 arrives in the building, person 11 has already begun to work and had been assigned to a working place that has been determined to be the present working place of the group, earlier or has assigned this working place by himself. Identification device 7 will identify person 10 to be a member of this certain group and send a signal to the processing device 3, comprising data of person 10. Processing device 3 will decide, what group person 10 has been assigned to, call an elevator car and automatically set the correct destination floor for this elevator car (here floor F10). Person 10 will enter the elevator car and be brought to the correct floor automatically.

As an additional option, the system may comprise display means 12, as shown in this example on identification module 7, where users of the system can get additional information, e.g. the room number or the work group, they will be assigned today, or the elevator car that should be used.

If the supervisor of the present group is going to visit this group, he will also be identified by the system. The system then can automatically call an elevator car and assign the correct destination by schedule or by an additional information about the desired group, given by the supervisor, e.g. via manual input by using keyboard 9.

The invention is not only limited to be applied to the embodiments described above, but instead many variations are possible within the scope of the inventive concept defined by the claims below. Thus, for example, the control system of the elevator system can comprise a number of separate control units, of which one or more control unit can belong to the access control system of the building.

REFERENCE SIGNS

| | |
|---|---|
| 1 & 2 | elevator cars |
| 3 | processing device |
| 4 & 5 | motor units |
| 6 | data line |
| 7 | identification device |
| 8 | receiving unit |
| 9 | keyboard |
| 10 & 11 | persons |
| 12 | display means |
| 13 | person (supervisor) |

The invention claimed is:

1. A method for an allocation of at least one elevator in an elevator system comprising the steps:

identifying at least one passenger;

searching for the group or the groups the at least one passenger is assigned to in an internal database or assigning the at least one passenger to a group or to groups, where the assignment is based on information of an internal database; and calling an elevator car for this at least one passenger and assigning to this elevator car the destination of one group the at least one passenger is assigned to, wherein a person using the system as the passenger has the possibility to affect the allocation through an additional input.

2. The method as claimed in claim 1, wherein the identification of a person is accomplished by using at least one identification device, after the person has entered the building or the elevator zone or passed another special position in the building.

3. The method as claimed in claim 1, wherein the searching for the group or the groups the respective person is assigned to is executed by searching the identified person in an internal database of the system or an external database to which the processing device of the system has access and to look up the information to which group this person is assigned to, or an assignment procedure is executed by searching the profile of the identified person in the database and assign this person to a group where the profile fits best.

4. The method as claimed in claim 1, wherein the destination floor for each member of the work groups particularly depends on the work area of the respective group and the work area of each work group is assigned by the first member of the respective group entering the building or the work area of each work group is assigned automatically based on environmental data, by decision of authorities or by schedule.

5. The method as claimed in claim 1, wherein additional information is presented on means to present this information.

6. The method as claimed in claim 1, wherein the elevator system comprises more than one elevator and two or more members of a certain work group had been identified, wherein these members are assigned to one single elevator car, as well as all other passengers with the same or a similar destination are assigned to this elevator car, wherein the special assignment of the elevator is especially displayed for the respective passengers.

7. The method as claimed in claim 1, wherein in the case of groups comprising a large number of members, one of the elevators is reserved for passengers travelling to the floor comprising the work area of this group, only.

8. A computer program which when executing on a computer performs the method of claim 1.

9. The computer program of claim 8, when stored on a computer readable medium.

10. An elevator system, comprising:

one or more elevators;

at least one identification device, suitable to identify passengers; and at least one processing device, suitable to activate calls for one or more individual elevators of the elevator system, based on the information of the at least one identification device, and wherein the elevator system is designed to execute the method as claimed in claim 1.

11. The elevator system as claimed in claim 10, wherein the at least one identification device is able to identify a person entering the building or at least a person intending to use an elevator of the elevator system, and/or the at least one processing device is able to process the passenger data, allocate a destination to an elevator car of the elevator system used by the respective passenger, call this elevator car to the position of the respective passenger and direct the elevator car to the allocated destination of the passenger.

12. The method as claimed in claim 1, wherein the additional input is a mobile device ("MOP"), an elevator system UI ("DOP"), a manual input device or a system override.

13. The method as claimed in claim 1, wherein the identification of a person is accomplished by using at least one identification device, after the person has entered the building or the elevator zone or passed another special position in the building, wherein to identify a person there are used items carried by this person, including ID-cards or RFID-devices, and/or biometric features of the person, the biometric features being fingerprints or the face of the person.

14. The method as claimed in claim 1, wherein additional information is presented on means to present this information, including display means or means for data transfer, wherein the display means are used to show information for each identified person, including information about the group this person is actually assigned to, the location of team members, the team members already present in the work area or the exact position of the work area, and the means for data transfer are used to send data to a mobile device of a person where the information can be displayed.

15. The method as claimed in claim 2, wherein the searching for the group or the groups the respective person is assigned to is executed by searching the identified person in an internal database of the system or an external database to which the processing device of the system has access and to look up the information to which group this person is assigned to, or an assignment procedure is executed by searching the profile of the identified person in the database and assign this person to a group where the profile fits best.

16. The method as claimed in claim 2, wherein the destination floor for each member of the work groups particularly depends on the work area of the respective group and that the work area of each work group is assigned by the first member of the respective group entering the building or the work area of each work group is assigned automatically based on environmental data, by decision of authorities or by schedule.

17. The method as claimed in claim 3, wherein the destination floor for each member of the work groups particularly depends on the work area of the respective group and that the work area of each work group is assigned by the first member of the respective group entering the building or the work area of each work group is assigned automatically based on environmental data, by decision of authorities or by schedule.

18. The method as claimed in claim 2, wherein additional information is presented on means to present this information, including display means or means for data transfer, wherein the display means are used to show information for each identified person, including information about the group this person is actually assigned to, the location of team members, the team members already present in the work area or the exact position of the work area, and the means for data transfer are used to send data to a mobile devices of a person where the information can be displayed.

19. The method as claimed in claim 3, wherein additional information is presented on means to present this information, including display means or means for data transfer, wherein the display means are used to show information for each identified person, including information about the group this person is actually assigned to, the location of team members, the team members already present in the work area or the exact position of the work area, and the means for data transfer are used to send data to a mobile devices of a person where the information can be displayed.

20. The method as claimed in claim 4, wherein additional information is presented on means to present this information, including display means or means for data transfer, wherein the display means are used to show information for each identified person, including information about the group this person is actually assigned to, the location of team members, the team members already present in the work area or the exact position of the work area, and the means for data transfer are used to send data to a mobile devices of a person where the information can be displayed.

* * * * *